US008262258B2

(12) United States Patent
VanderSluis et al.

(10) Patent No.: US 8,262,258 B2
(45) Date of Patent: Sep. 11, 2012

(54) SYSTEM FOR RETROFITTING AN EXISTING LIGHT FIXTURE WITH AN LED LUMINAIRE

(75) Inventors: Donald VanderSluis, Sarasota, FL (US); Robert Fugerer, Lutz, FL (US)

(73) Assignee: Sunovia Energy Technologies, Inc., Sarasota, FL (US)

( * ) Notice: Subject to any disclaimer, the term of this patent is extended or adjusted under 35 U.S.C. 154(b) by 0 days.

(21) Appl. No.: 13/201,830

(22) PCT Filed: Feb. 16, 2010

(86) PCT No.: PCT/US2010/024321

§ 371 (c)(1),
(2), (4) Date: Aug. 16, 2011

(87) PCT Pub. No.: WO2010/094041

PCT Pub. Date: Aug. 19, 2010

(65) Prior Publication Data

US 2011/0299281 A1 Dec. 8, 2011

Related U.S. Application Data

(60) Provisional application No. 61/152,850, filed on Feb. 16, 2009.

(51) Int. Cl.
*F21V 9/00* (2006.01)

(52) U.S. Cl. ..... 362/249.02; 362/373; 362/294; 362/346

(58) Field of Classification Search ..... 362/249.02, 362/373, 294, 800, 253, 252, 191, 249, 364, 362/646, 555, 434, 227, 240; 313/110–113
See application file for complete search history.

(56) References Cited

U.S. PATENT DOCUMENTS

| | | | |
|---|---|---|---|
| 7,488,097 | B2 | 2/2009 | Reisenauer et al. |
| 2004/0066142 | A1 | 4/2004 | Stimac et al. |
| 2008/0278955 | A1 | 11/2008 | Boyer |

OTHER PUBLICATIONS

International Searching Authority, "Notification of Transmittal of the International Search Report and the Written Opinion of the International Searching Authority, or the Declaration," Sep. 30, 2010.

*Primary Examiner* — Joseph L Williams
(74) *Attorney, Agent, or Firm* — Holland & Hart LLP

(57) ABSTRACT

An adapter plate is provided that fits an existing luminaire in place of an existing globe that mounts to the luminaire. A heat sink mates to the adapter plate and also houses a solid state light engine and associated electronics. The heat sink may provide an enclosed, protective volume for the associated electronics, such as a power supply for the solid state light engine. A globe mounting ring attached to the heat sink allows either an existing globe to be re-mounted or a new globe to be installed.

20 Claims, 10 Drawing Sheets

SECTION A-A

SECTION A-A

SECTION A-A

SECTION A-A

SECTION A-A

SYSTEM FOR RETROFITTING AN EXISTING LIGHT FIXTURE WITH AN LED LUMINAIRE

CROSS-REFERENCE TO RELATED APPLICATIONS

This application claims priority to U.S. Provisional Patent Application No. 61/152,850, filed on Feb. 16, 2009, the disclosure of which is incorporated by reference herein in its entirety.

FIELD

The present disclosure related to solid state lighting fixtures, and, more specifically, to systems for replacing non-solid state lighting fixtures with solid state lighting fixtures.

BACKGROUND

High-power Light Emitting Diodes (LEDs) offer many advantages as sources of illumination as compared to other sources of illumination. For example, LEDs are significantly more efficient than incandescent bulbs. Lighting devices that rely on LEDs as the light source therefore consume significantly less power than an equivalent lighting device having one or more incandescent bulbs as the light source. LEDs also contain no mercury, such as found in compact fluorescent lamps (CFLs). Additionally, lighting devices that employ LEDs as the light source are solid-state devices and therefore more physically robust than incandescent, metal halide, sodium vapor lamps or CFLs. LED-based lighting devices also have a long lifetime, thus requiring fewer replacements as compared to most other lighting sources.

Luminaires can be designed around LEDs to make optimal usage of LEDs' advantages. Merely replacing a metal halide lamp in a streetlight with an LED source, for example, will yield less than optimal results due to the different optical and thermal requirements of LEDs as compared to metal halide lamps. However, there is a significant market demand for retro-fitting existing luminaires with LED sources. Optically, the output from an LED is much more directive and can be utilized best when the optical system is optimized around that characteristic. Thermally, LEDs emit far less heat than most other sources, however, the heat they do emit must be removed effectively in order for the LEDs to operate near their full potential.

SUMMARY

The present disclosure provides various embodiments of heat dissipation members that are able to effectively conduct thermal energy away from a solid state light engine. In one aspect, an adapter plate is provided that fits in the existing luminaire in place of an existing globe that mounts to the luminaire. A heat sink mates to the adapter plate and also houses a solid state light engine and associated electronics. The heat sink may provide an enclosed, protective volume for the associated electronics, such as a power supply for the solid state light engine. A globe mounting ring (also referred to as a globe mounting plate) allows either an existing globe to be re-mounted or a new globe to be installed. In various embodiments, a mount or mounts for a light redirecting mechanism are provided.

Adapter plates, in an aspect of the disclosure, include adaptor plates that are sized and shaped to accommodate hardware protuberances that may be present in an existing luminaire, and are adapted to accommodate the mounting of a globe or other cover that is associated with a luminaire. One or more heat sinks are mounted between two adaptor plates and facilitate the transfer of heat away from a solid state light engine and associated electronics. Alternatively, one or more adaptor plates or mounting rings may be integrally formed as part of a heat sink.

In one aspect, the present disclosure provides a solid state light fixture, comprising: (a) an adaptor plate that is adapted to be secured to a base to which the light fixture is to be mounted; (b) a heat sink adapted to be secured to the adaptor plate that comprises a light engine mounting surface and a globe adaptor ring mounting surface on a first side thereof, and a plurality of heat dissipating elements on a second side thereof; (c) a light engine mounted to the light engine mounting surface; (d) a power supply mounted to the second side of the heat sink that is electrically connected to the light engine; and (e) a globe adaptor ring adapted to be secured to the globe adaptor ring mounting surface, the globe adaptor ring adapted to receive an optically transmissive globe that encloses the light engine. The adaptor plate, heat sink, and globe adaptor ring are secured together, the heat dissipating elements providing a thermally conductive path between the heat sink and ambient air outside of the globe. In one embodiment, the heat sink further comprises a wall extending from the first side that encloses the light engine mounting surface, and a cover lens may be secured to a top of the wall such that the light engine is enclosed within the cover lens, wall, and light engine mounting surface. The light engine mounting surface may include one or more openings aligned with electrical connection elements of the light engine. In one embodiment, the light engine comprises a plurality of light emitting diodes (LEDs), and may also include a plurality of secondary optics associated with the LEDs. In another embodiment, the light fixture further comprises (f) a reflector support secured to a globe adaptor ring mount; and (g) a reflector secured to said reflector support configures to reflect light from said light engine to a target area. The light fixture of this aspect may be installed with an existing base for a non-solid state light fixture.

In another aspect, the present disclosure provides a system for securing a solid state light fixture to an existing light fixture pole having an existing mounting structure for an optically transmissive globe and a utility power source, comprising: (a) an adaptor plate that is adapted to be secured to the existing mounting structure; (b) a heat sink comprising a light engine mounting surface and a globe adaptor ring on a first side thereof, and a plurality of heat dissipating elements on a second side thereof, the heat sink adapted to be secured to the adaptor plate; (c) a light engine mounted to the light engine mounting surface; and (d) a power supply located on the second side of the heat sink that is electrically connected to the light engine and adapted to be electrically connected to the utility power source. The globe adaptor ring is adapted to receive an optically transmissive globe that encloses substantially all of the first side of the heat sink, and when the adaptor plate and heat sink are secured together to the existing mounting structure, the heat dissipating elements provide a thermally conductive path between the heat sink and ambient air outside of the globe.

BRIEF DESCRIPTION OF THE DRAWINGS

Various embodiments, including preferred embodiments, and the currently known best mode for carrying out the invention, are illustrated in the drawing figures, in which.

DETAILED DESCRIPTION

The present disclosure recognizes that one challenge with retro-fitting LED sources into existing non-solid-state luminaire designs is to provide an effective thermal path from the LED sources to a cooler external environment. The present disclosure describes several embodiments for dissipating heat from an LED source retrofitted into an existing luminaire into the environment external to the luminaire. It is noted that there are very few, if any, present-day LED luminaire retro-fit products that are effective in removing the heat generated by the LEDs to the outside environment. Present retrofit methods place an LED light engine coupled to a heat sink in place of the prior lamp assembly. This may be in an open air luminaire but more commonly is in a luminaire with a globe enclosing the lamp assembly. This globe typically provides protection against the weather but also tends to keep the heat generated by the lamp assembly internal to the globe. This heating was not necessarily an issue with metal halide or other mature technology lamps, but past a certain power range this tendency to trap heat inside of a globe may increase the temperature of LEDs to the point that the LED junction may degrade and decrease the lifetime of the lamp.

The present disclosure provides embodiments that reduce internal heat build-up in LED light engines by providing a sufficient thermal path to the outside of the luminaire. This allows heat to be removed from the LEDs thus enabling longer-life operation. Another issue with LED luminaire retro-fit products is adaptability to existing luminaires. Internal lamp assemblies and their mountings vary from manufacturer to manufacturer and even from model to model from the same manufacturer. Creating a matching adaptor for each of those in a retrofit assembly may be cost-prohibitive. However, each enclosed luminaire has a mounting area for the globe that encloses it. This globe is readily removable on traditional luminaires due to the necessity of regular lamp replacement. This intentional serviceability allows the novel features described herein to be installed readily on nearly any luminaire that has a globe or other similar protective enclosure.

Figure 1A:
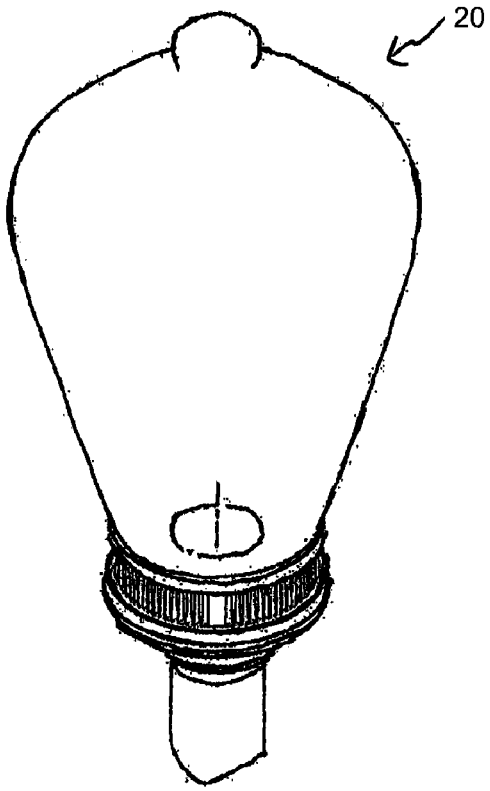
FIG. 1A is top perspective illustration of a luminaire of an exemplary embodiment of the present disclosure.
Figure 1B:
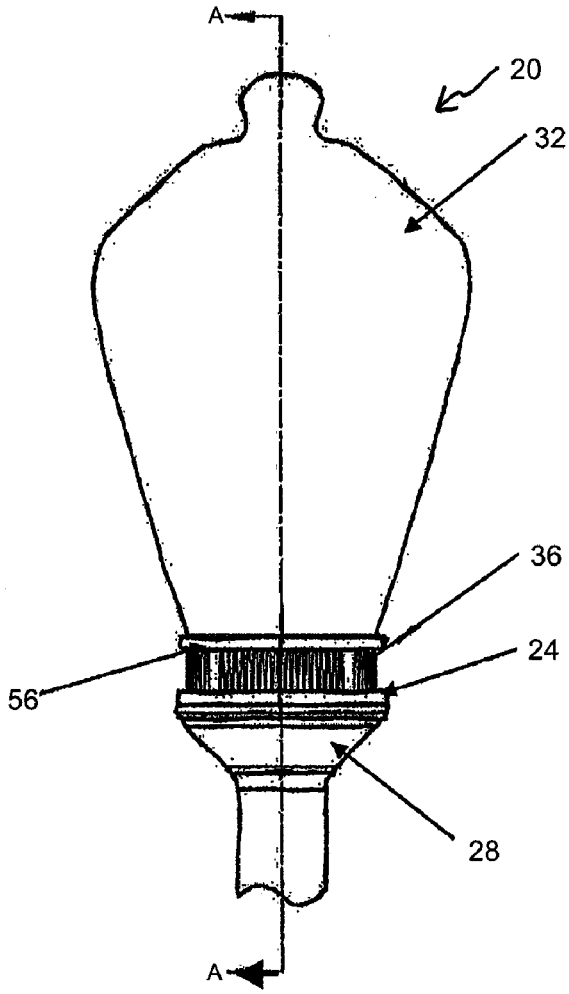
FIG. 1B is an elevation view of the luminaire of FIG. 1A.
Figure 2:
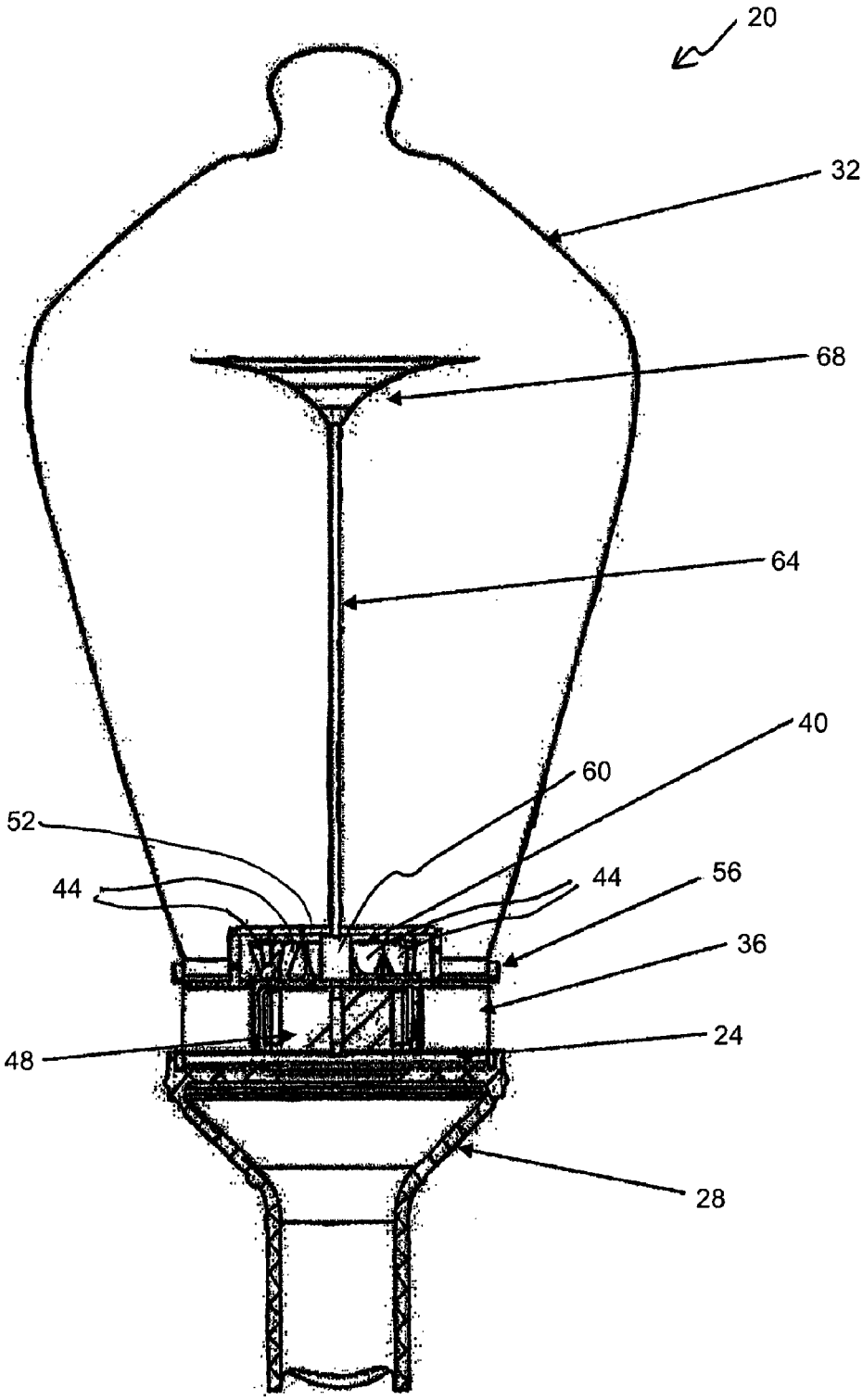
FIG. 2 is a cross-sectional illustration along the section A-A of FIG. 1B.
Figure 3:
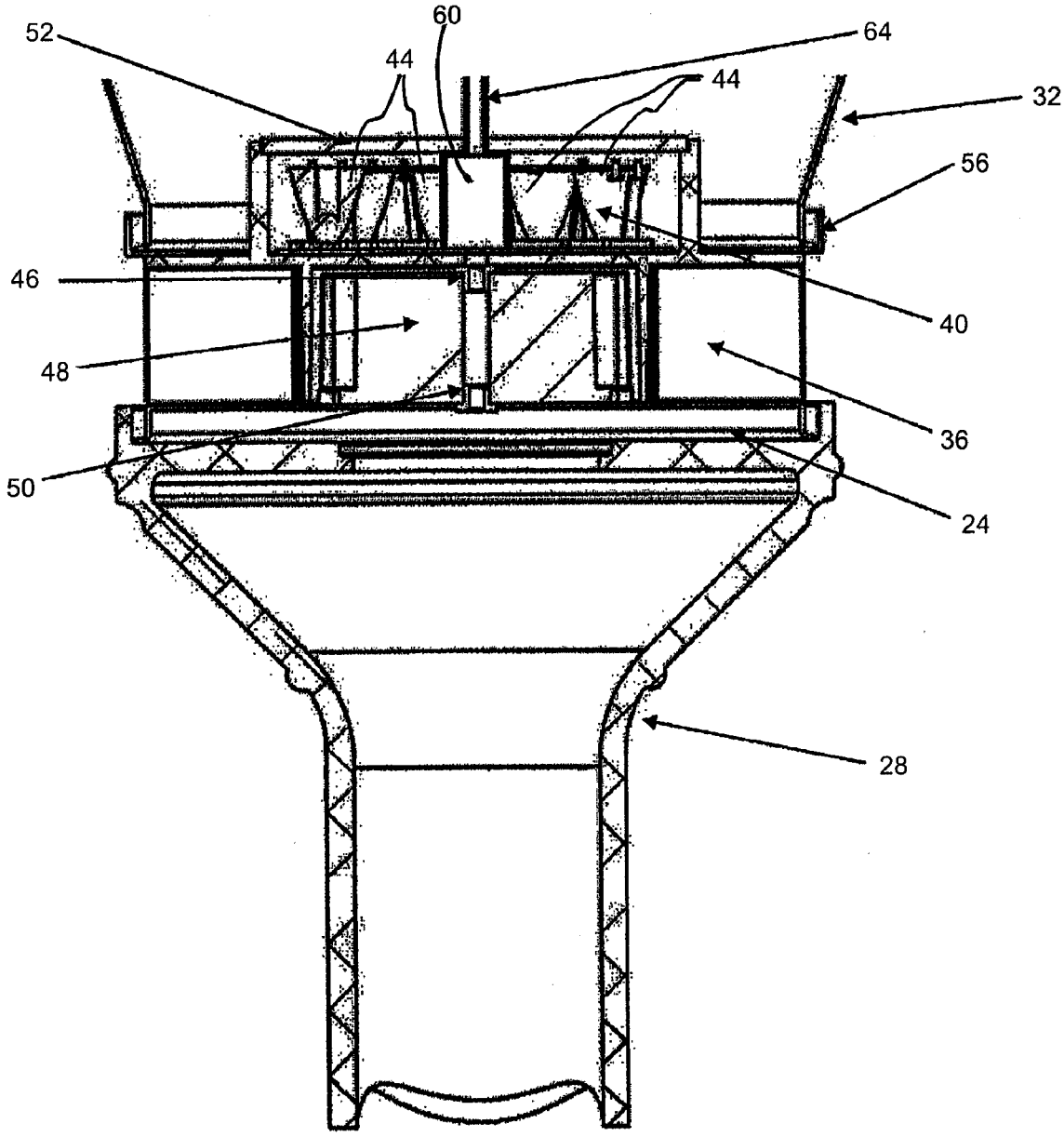
FIG. 3 is a blown-up view of a portion of the cross-sectional illustration of FIG. 2.

With reference first to FIGS. 1-3, described are the components of an embodiment in which a pole top luminaire 20 has an adapter plate 24 that engages with the pole top 28 in place of the existing globe 32. A heat sink 36 mates to the adapter plate 24, and provides a path for thermal conduction away from an LED light engine 40 is mounted to the heat sink 36. In this embodiment, the LED light engine 40 includes a plurality of LED light elements 44. LED light elements 44 are well known in the art, and typically include a number of discrete light emitting diodes that are mounted to a circuit board, and optical elements such as a collimator that provides desired beam characteristics for the emitted light. The LED light engine 40 further includes connectors 46 for electrical connection between the LED light engine 40 and a power supply 48 (also referred to as a LED driver). The power supply 48, in this embodiment, includes a connector 50 that connects to an existing power source available to the pole top lighting fixture. Such an existing power source may be, for example, commonly provided 120 Volt AC utility power. In such a case, the power supply 48 converts the utility power into direct current power that is usable by the LED light engine 40. In some embodiments, the power supply 48 includes a battery that can be used to provide operating power to the LED light engine 40 when utility power is not available or it is not desired to use utility power. In some embodiments, the LED light engine 40 also includes processing electronics that can adjust the output of the LED light elements 44 based on preset operating criteria. The LED light engine 40 may also include communications capability to allow for communications to and/or from an external source, and/or programming by an external source. The LED light engine 40 further includes a cover lens 52 that covers the LED light elements 44.

A globe adapter ring 56 is mounted to the heat sink 36. The globe 32 may then be mounted to the globe adapter ring 56 to provide an enclosed, protective volume for the LED light engine 40 and associated power supply 48 (LED driver circuitry). The globe adapter ring 56 allows either an existing globe to be re-mounted, or a new globe to be installed, and also, in this embodiment, includes a mount 60 for a light redirecting mechanism. In the embodiment of FIGS. 3-1, the light redirecting mechanism includes a reflector support 64 having a reflector 68 mounted on a top portion thereof. The reflector support 64 may be a central support extending up from a central portion of the globe adaptor ring 56, as illustrated in the embodiment of FIGS. 1-3, or include one or more supports that extend up from peripheral portions of the globe adaptor ring 56. The light redirecting mechanism in the embodiment of FIGS. 1-3 includes in inverted cone reflector 68, although other light redirecting mechanisms may be used, such as a non-inverted cone or an array for turning prisms, for example.

In the exemplary embodiment of FIGS. 1-3, the adapter plate 24 is shown mounted into a fixture that has either minimal internal structure after the removal of an existing lamp assembly or internal structure that itself is readily removable. Such fixtures are common in currently installed pole top lighting installations. In such a manner, existing luminaires may be retro-fitted with a high-efficiency solid-state LED light engine 40. The replacement LED light engine 40 is provided with adequate heat-transfer components to provide heat transfer away from the LEDs and associated circuitry within the LED light engine 40. In this embodiment, the heat sink assembly 36 is mounted to the adapter plate 24 along with the power supply 48. In this embodiment, the LED light engine 40 is mounted in the heat sink 36 under the cover lens 52 and is thus inside a sealed, protected volume. Above the LED light engine 40 is the globe 32 of an optically transmissive material which may be tempered glass, acrylic, polycarbonate or another material. This material may also be diffuse to some extent, if that is necessary to achieve a desired particular pattern of light. The light redirecting mechanism illustrated in FIGS. 2 and 3, as mentioned, may be any suitable mechanism for reflecting, diffusing, and/or refocusing light in a desired manner, such mechanisms being readily known to one of skill in the art. For example, it may desired to light a specified target area using the light fixture, and the light redirecting mechanism may be configured to reflect light from the LED light engine 40 to the target area to be lighted. In this embodiment, the light redirecting mechanism includes an inverted cone reflector 68 that may be comprised of either metal, which may be spun, formed, stamped, cast, molded or made by some other means or may be of metal-coated polymer. In other embodiments, the light redirecting mechanism may be a non-inverted cone, supported around its periphery and/or turning prisms, for example. The light redirecting mechanism may be constructed to provide either a symmetric or asymmetric light distribution pattern.

As mentioned, the components as described in FIGS. 1-3 may be used to retrofit existing luminaires, such as metal-halide lamps for example, with a solid state light. In such a case, a decision is made to replace such lamps with solid state lighting. This decision may be made based on cost and energy savings, reduced maintenance, tax incentives for efficient lighting, and/or any other of a variety of factors that may go into such a decision. In many cases replacement of non-solid-state lighting with solid-state lighting may be more cost effective if the existing installed lighting system can be retrofitted with an effective solid-state system. The embodiments described herein provide options for such replacement. When it is decided to do a replacement, the globe of the existing luminaire is removed and the existing lamp, such as a metal-halide lamp, is removed. Hardware components that are used to secure the existing lamp may be removed in some cases, although in other cases the replacement solid-state light unit may be designed to be coupled with the existing lamp components. In cases where the existing hardware is to be removed, this hardware is removed and the power input is appropriately connected to the replacement light. The adapter plate is used to secure the new light to the existing mounting assembly for the existing globe. Any light re-directing mechanism may be mounted to the replacement light. The existing globe, or a replacement globe, may then be mounted to the globe adaptor ring on the new light unit. The heat sink of the replacement solid state light is located between the adaptor plate and the globe adaptor ring, thus providing a thermal path between the light engine of the replacement light and outside ambient air. In such a manner, retrofits may be made that avoid the need for a complete replacement of existing lighting hardware, light poles, etc. Furthermore, a common LED engine design, power supply design, and heat sink design may be coupled to different adaptor plates and globe adaptor rings that are selected based on the particular lamp assemblies that are being retro-fitted. That is, the same light engine, power supply, and heat sink may be used in multiple different applications, with suitable adaptor rings provided to proper engagement to the existing light structure.

Figure 4A:
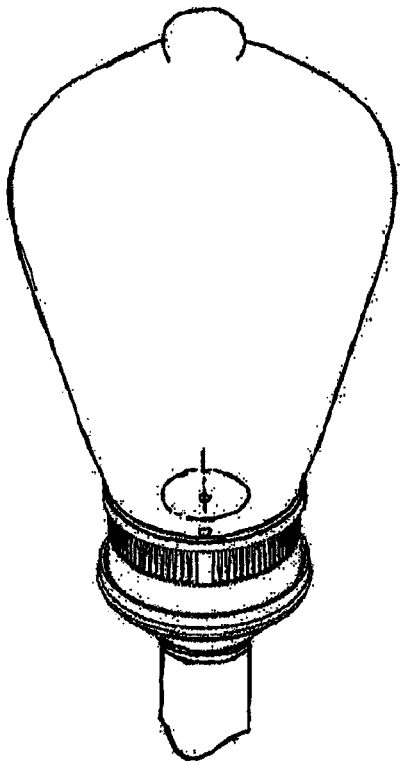
FIG. 4A is top perspective illustration of a luminaire of another exemplary embodiment of the present disclosure.
Figure 4B:
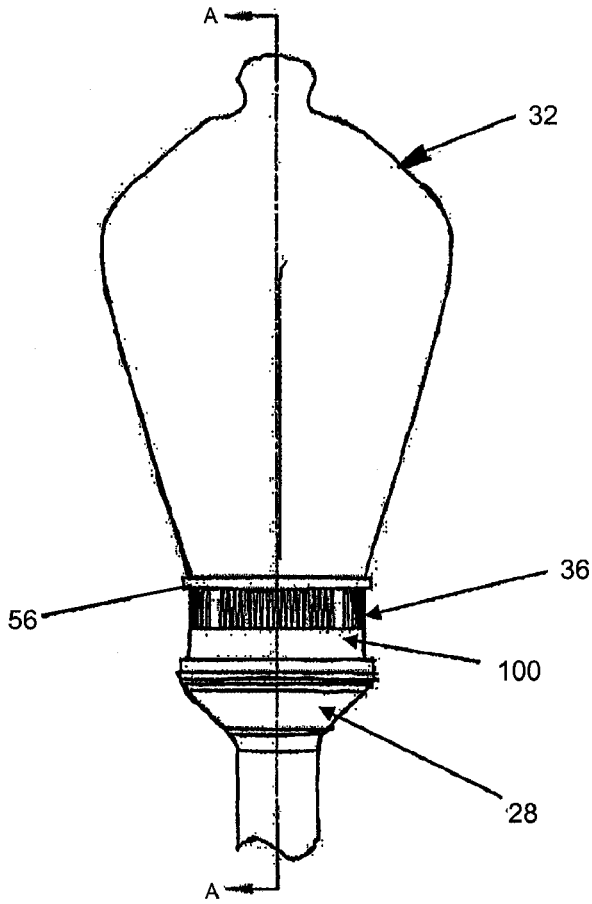
FIG. 4B is an elevation view of the luminaire of FIG. 4A.
Figure 5:
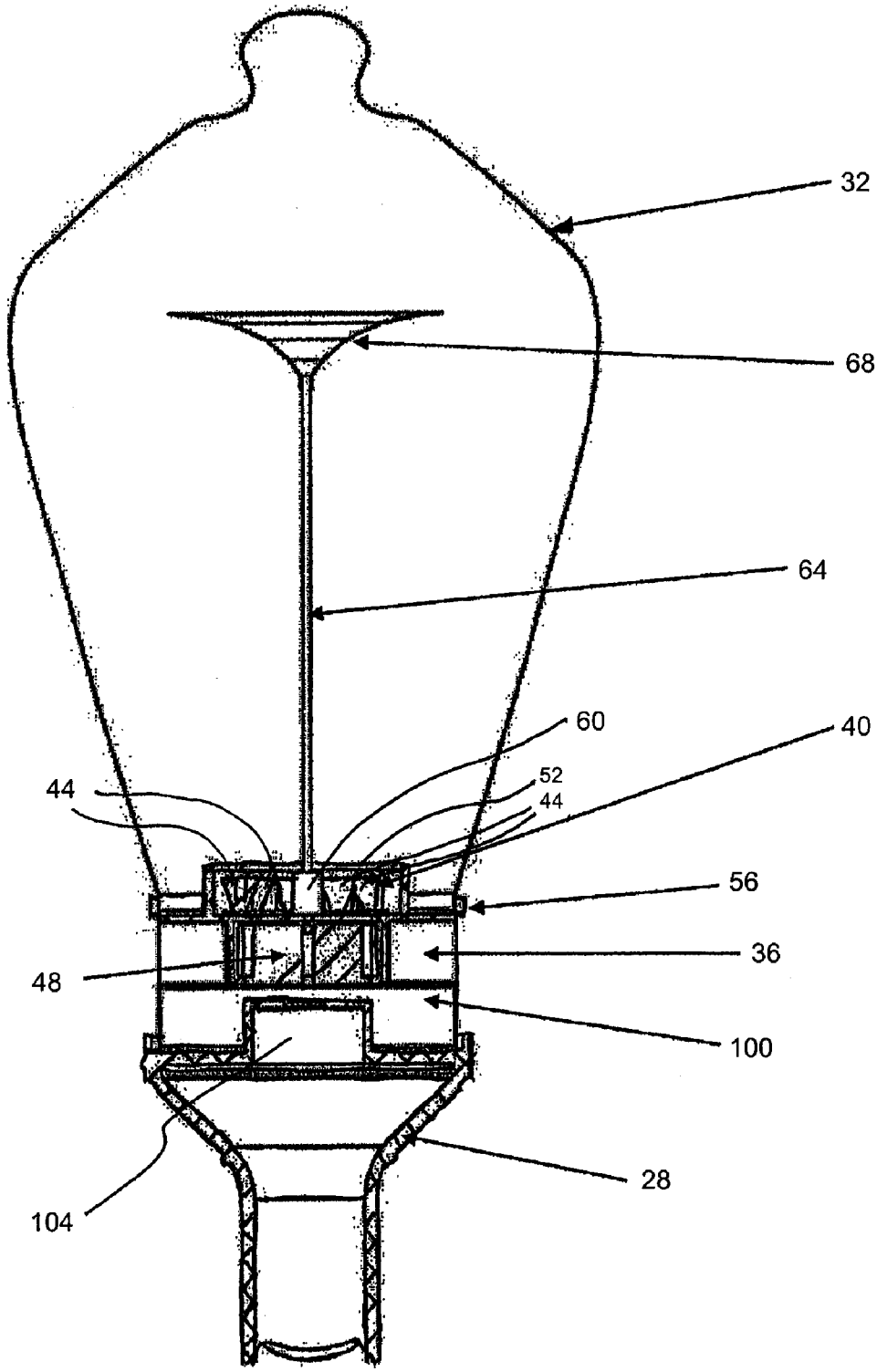
FIG. 5 is a cross-sectional illustration along the section A-A of FIG. 4B.
Figure 6:
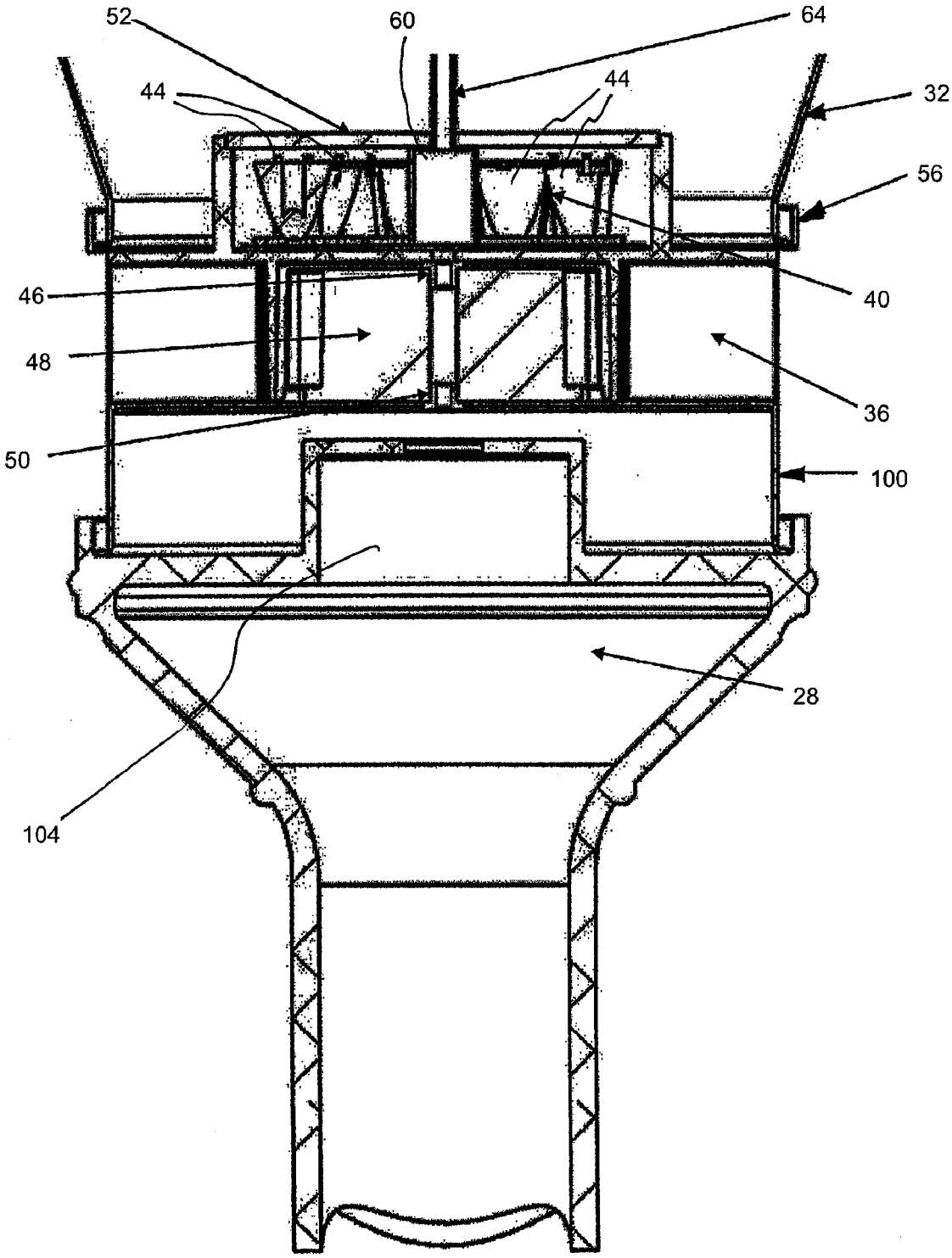
FIG. 6 is a blown-up view of a portion of the cross-sectional illustration of FIG. 5.

With reference now to FIGS. 4-6, another exemplary embodiment is illustrated. In this embodiment, adapter plate 100 is mounted into a luminaire that has a non-removable internal structure 104 that extends above the ring used to mount the globe assembly 32. In traditional installed systems, this internal structure 104 is used to mount the traditional lamp in the lamp fixture, with the globe 32 extending over both the lamp and internal structure. However, in cases where it is desired to replace the traditional lamp (such as a metal-halide lamp) with a solid state light unit, such an internal structure 104 can require additional modifications as illustrated in this embodiment in order to provide enhanced heat dissipation through a heat sink 36. The exemplary embodiment of FIGS. 4-6 provides an adapter plate 100 that is designed to accommodate such an internal structure 104 to allow the remainder of the retro-fit assembly to be mounted in substantially the same manner as described above with respect to FIGS. 1-3. The heat sink 36 assembly is shown mounted to the adapter plate 100 along with the power supply 48. Mounted in the heat sink 36, inside a sealed, protected volume beneath a cover lens 52 is the LED light engine 40, above which is the globe 32 of optically transmissive material which may be tempered glass, acrylic, polycarbonate or another material. This material may also be diffuse to some extent, if that is necessary to achieve a particular pattern of light where it's needed. The mount 60 for a light redirecting mechanism is also shown, as is the light redirecting mechanism 64, 68, although such a light redirecting mechanism may not be present in all embodiments or applications. In this embodiment, the light redirecting mechanism includes an inverted cone reflector 68 that may be comprised of either metal, which may be spun, formed, stamped, cast, molded or made by some other means or may be of metal-coated polymer. The light re-directing mechanism may be a non-inverted cone, supported around its periphery. Alternatively, the light redirecting mechanism may be comprised of turning prisms, etc., and may be constructed to provide either a symmetric or asymmetric light distribution pattern.

In some exemplary embodiments, the power supply for the LED engine may be either wired or connectorized on the top, in order to mate with a matching connector on the bottom of the LED light engine. The power supply may also be either wired or connectorized on the bottom in order to be connected to the mains from the existing lamp assembly. Fully or partially connectorized power supplies may provide considerable labor savings cost during assembly and installation of a retrofit project. Adapter plates of other embodiments may be made in various heights and diameters to accommodate various sized luminaires. The adapter plates may be stamped, formed, drawn, spun, cast, molded or made by some other method. The adapter plates also may have an angled top to provide for drainage.

With reference to FIGS. 7-10, various exemplary embodiments of heat sinks of the present disclosure are illustrated. The heat sink provides the capability of coupling an internal, sealed LED light engine to an external cooling medium (such as air), rather than simply heating and re-heating the air internal to the globe that is mounted to the luminaire. In the various exemplary embodiments, the heat sink fins are oriented to maximize the likelihood of airflow regardless of wind direction. The gap between the fins and the internal protected volume intended for the power supply facilitates the free movement of air from one side of the sink to the other. The height of the fins and thus the overall height of the heat sink may be reduced to reduce cost for a lower power light engine or increased to provide sufficient cooling for higher power light engine. Other shapes and variations are clearly possible such as variation in the number and spacing of the heat sink fins or the use of an arrangement of pin fins, etc. Further, an external shield may be provided to provide some protection against external contaminants.

Figure 7:
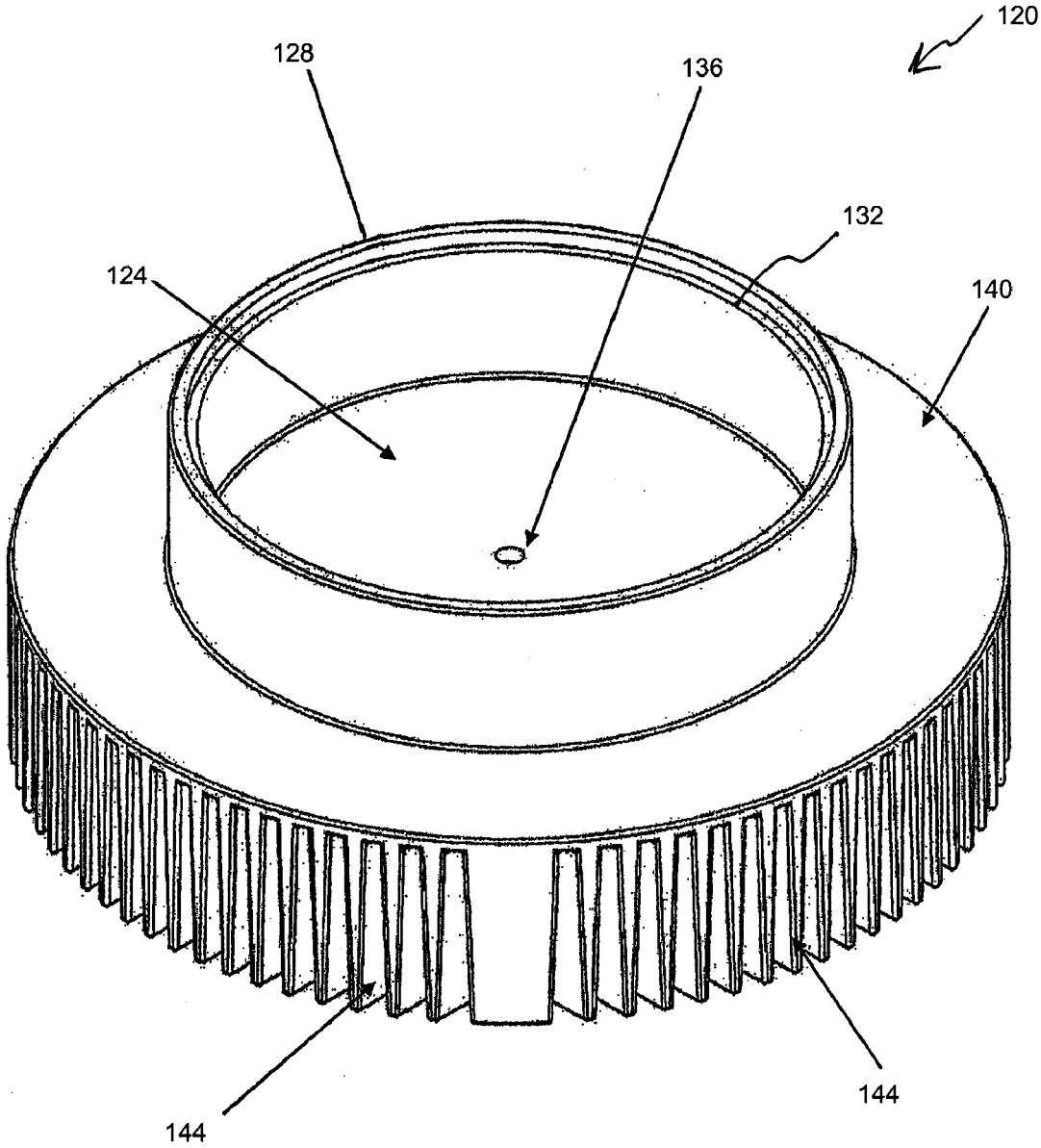
FIG. 7 is a top perspective view of a heat sink of an exemplary embodiment.
Figure 8:
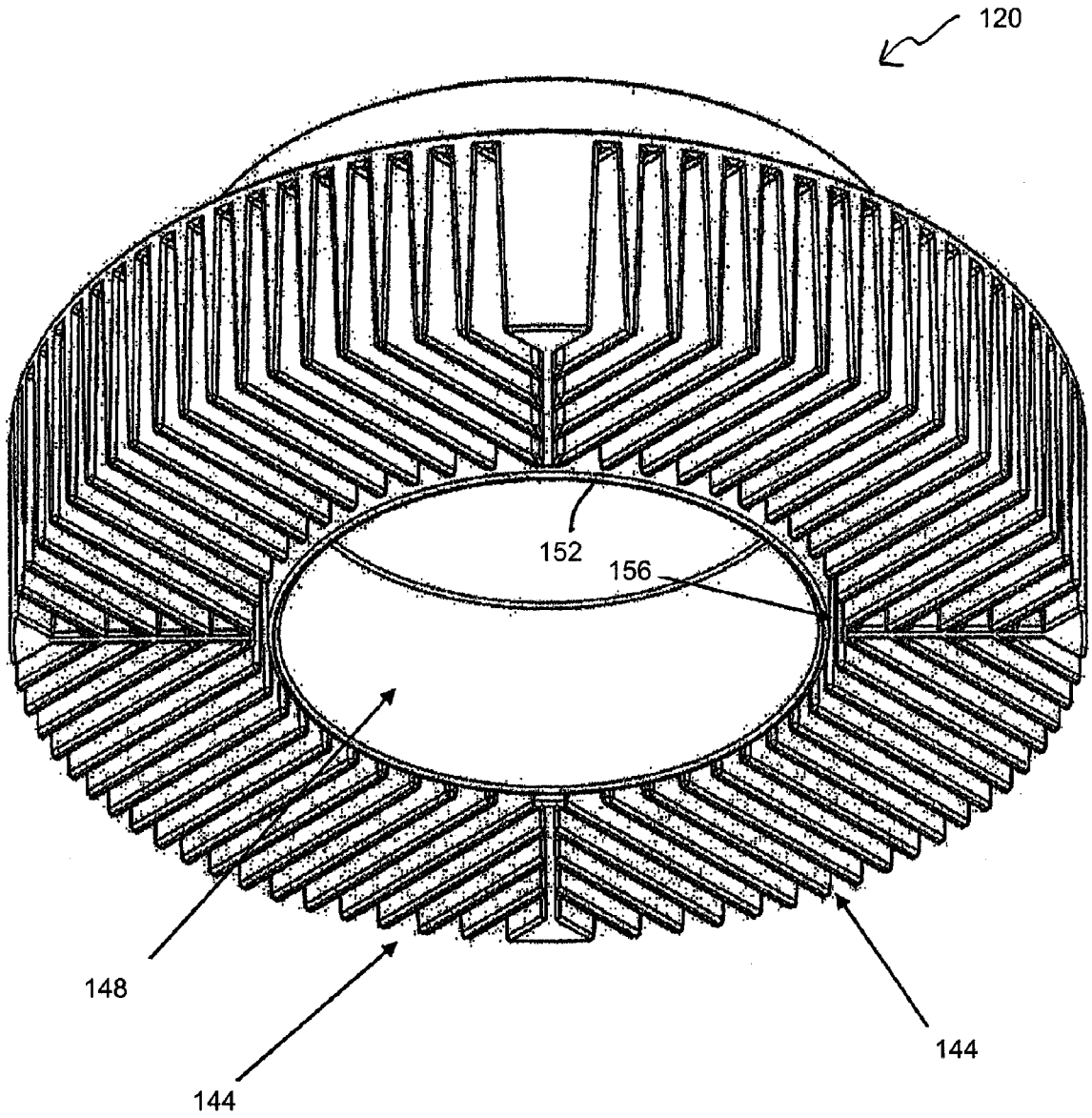
FIG. 8 is a bottom perspective view of the heat sink of FIG. 7.

With reference to FIGS. 7 and 8, illustrated is an exemplary heat sink 120. The heat sink 120, in this embodiment, includes a mounting surface 124 for the LED light engine. The mounting surface 124, in this embodiment, has a generally circular shape, although other configurations, such as a square or rectangle, are possible in other embodiments. The mounting surface 124 is surrounded by a wall 128 that extends up from the mounting surface 124 to a height that is slightly higher than the height of the LED light engine that is mounted on the mounting surface 124. In this embodiment, the wall 128 includes a ledge 132 that is adapted to receive a cover lens that is placed over the LED light engine. A LED light engine may be placed in the volume defined by the mounting surface 124 and wall 128, and secured to the mounting surface through a thermally conductive adhesive. Heat generated by the LED light engine is thus transferred through the thermally conductive adhesive to the heat sink 120. Of course, other methods may be used to attach the LED light engine to the mounting surface, such as screws, for example. With the LED light engine secured to the mounting surface 124, a cover lens may be placed over the LED light engine and secured, such as through an adhesive, to the ledge 132 to provide a sealed volume that contains the LED light engine.

As discussed above, the LED light engine may include one or more connectors that are used to make power and/or data connections. The heat sink 120 of this embodiment includes a connector access opening 136 through which electrical connections between the LED light engine and power supply may be completed. The connector access opening 136 may, of course, have different configurations or multiple openings, depending upon the electrical connections required for the LED light engine of the particular embodiment. The heat sink 120 includes a second mounting surface 140 for mounting a globe adaptor ring. The globe adaptor ring, as discussed above, is configured to secure a globe to the light fixture, and may be one of a number of different configurations depending upon the particular globe that is to be secured to the light fixture. The globe adaptor ring may be secured to the second mounting surface 140 through any appropriate method, such as, for example, through welding, adhesive, screws, pins, braces, dogs, detents, or latches, to name a few. The heat sink of this embodiments includes fins 144 that are arranged in separate sections, with fins 44 of the different sections arranged at different angles than fins 44 of adjacent sections. The different arrangement of the angles of the fins 44 of adjacent sections provides for enhanced air flow.

The bottom side of the heat sink 120 contains the cooling fins 44 in this embodiment, and formed in the cooling fins is a power supply area 148 defined by a wall 152 that creates a volume in which a power supply may be situated. The particular configuration of the power supply area 148 and wall 152 may be altered to accommodate the particular shape of the power supply that is used at the driver for the LED light engine, and may be a circular, square, or rectangular configuration, for example. A power supply may be secured within the power supply area 148 through screws, adhesive, or any other appropriate attachment means. In other embodiments, the power supply is secured to an adaptor plate that is secured to the heat sink 120. In the embodiment of FIGS. 7-8, the fins 144 extend from an outer circumference of the heat sink 120 to an inner portion of the bottom side that is a small distance from the wall 156 that defines the power supply area 148. This creates a gap 156 between the end of the fins 144 and the wall 152. Such a gap 156 provides for enhanced air flow through the heat sink 120.

An adaptor plate may be secured to the bottom of heat sink 120 through any suitable attachment method, such as through screws, welding, or adhesive, for example. In other embodiments, an adaptor plate is secured to an installed base, such as a pole top light fixture, and the heat sink 120 with the globe adaptor ring then mounted to the adaptor plate through any suitable attachment method. In still other embodiments the adaptor plate and globe adaptor ring include complementary clamping-type devices that are used to clamp the heat sink 120 between the adaptor plate and globe adaptor ring. The globe adapter ring that is mounted to the heat sink opposite the adaptor plate may be made in various heights and diameters to accommodate various sized globes or other protective and/or optical enclosures. The adapter rings may be stamped, formed, drawn, spun, cast, molded or made by some other method.

Figure 9:
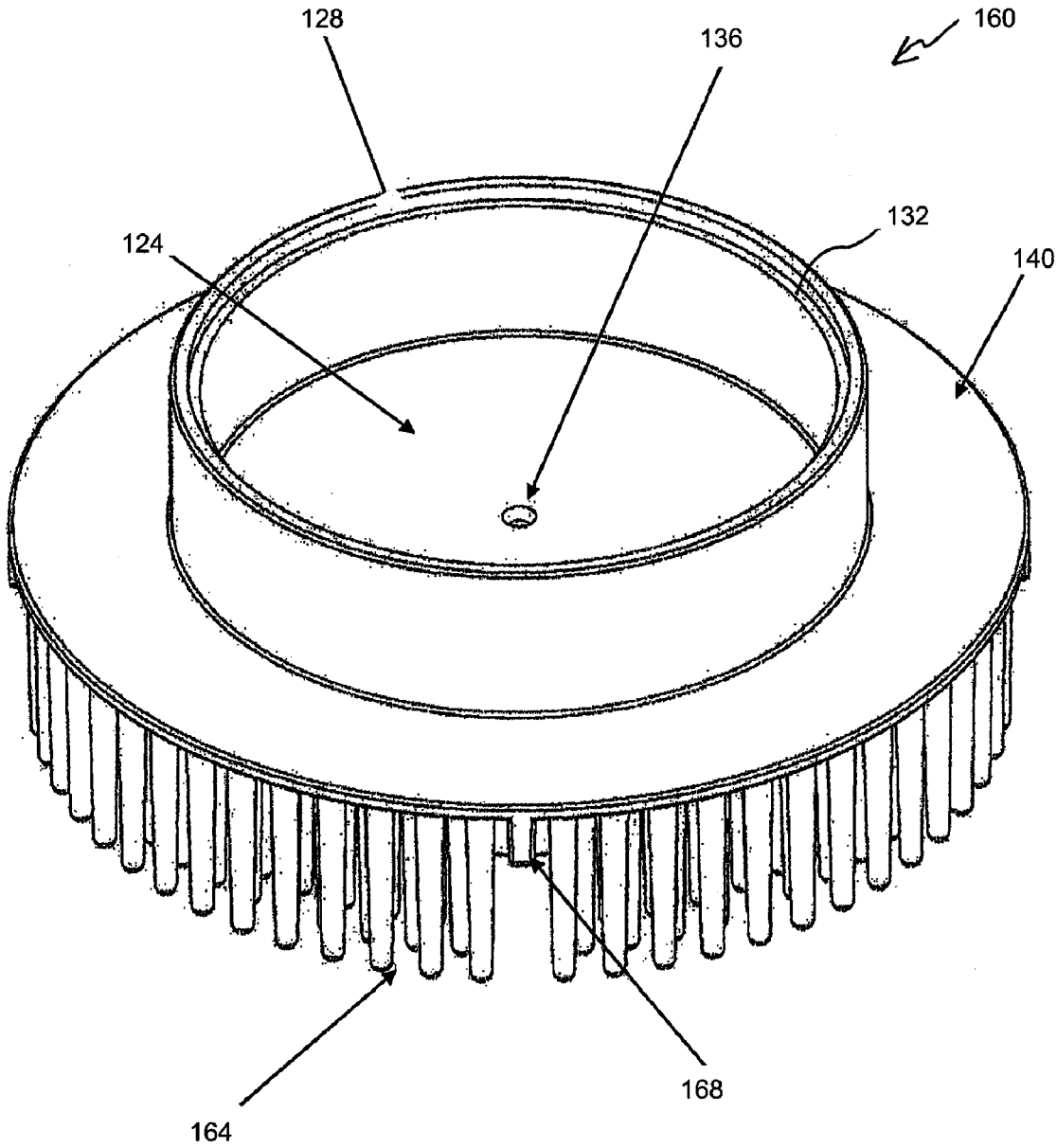
FIG. 9 is a top perspective view of a heat sink of another exemplary embodiment.
Figure 10:
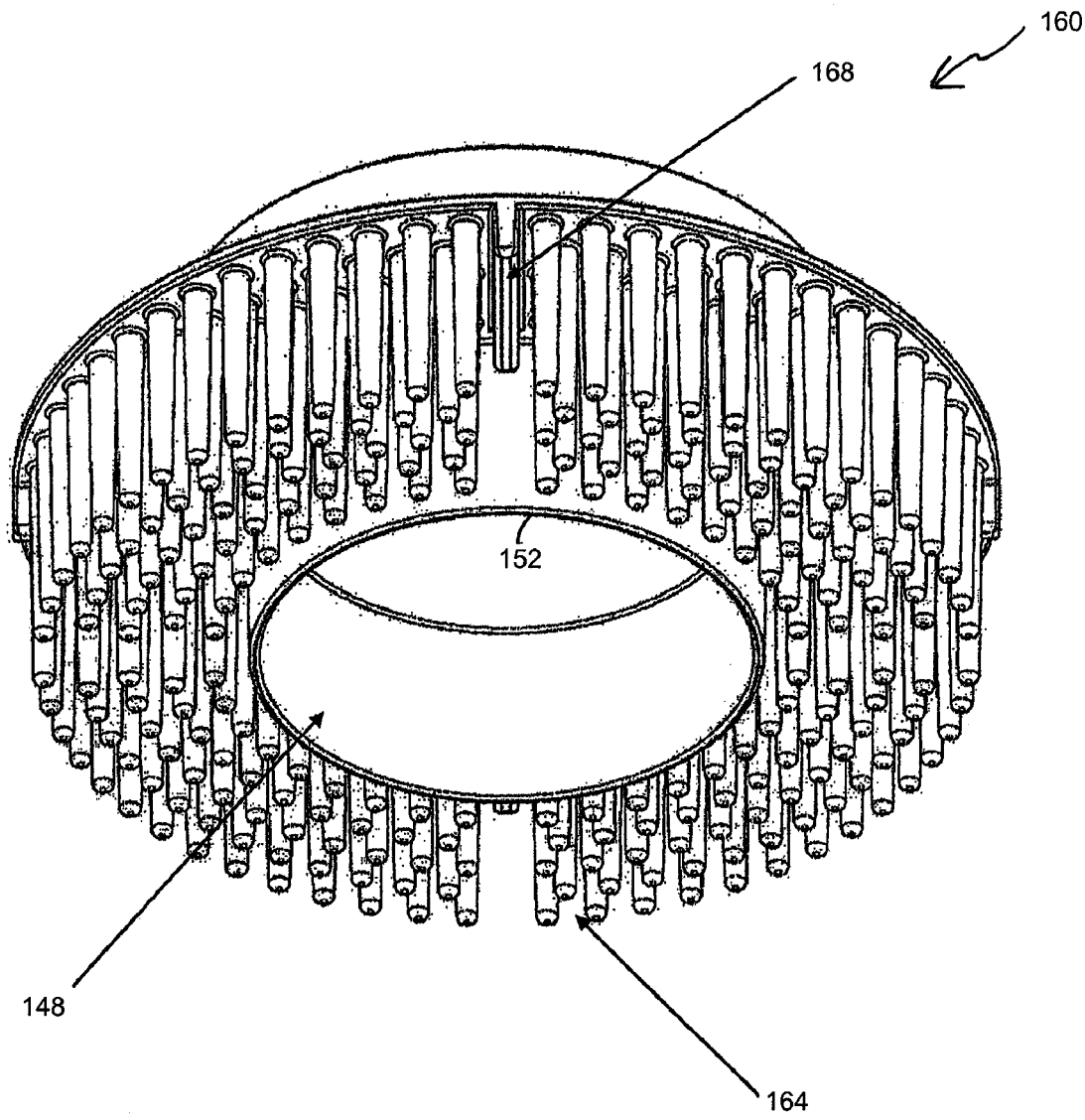
FIG. 10 is a bottom perspective view of the heat sink of FIG. 9.

With reference to FIGS. 9-10, a heat sink 160 of another embodiment is illustrated. The heat sink 160 in this embodiment includes many similar elements as described with respect to FIGS. 7-8. The heat sink 160 of this embodiment includes pins 164 rather than heat dissipating fins such as in the embodiment of FIGS. 7-8. Heat dissipating pins 164 may provide enhanced air flow through the heat sink 160. One or more reinforcing ribs 168 may be included that provide additional stiffness to the top plate of the heat sink 160, and may also act as heat dissipating fins.

While a light engine having LEDs has been described in the above embodiments, it will be understood that other types of solid state lighting elements may be used. Quantum Dots, for example, are semiconductor nanocrystals that possess unique optical properties. The emission color of quantum dots can be tuned from the visible throughout the infrared spectrum. This allows quantum dot LEDs to create almost any output color. Organic light-emitting diodes (OLEDs) include an emitting layer material that is an organic compound. To function as a semiconductor, the organic emitting material must have conjugated pi bonds. The emitting material can be a small organic molecule in a crystalline phase, or a polymer. Polymer materials can be flexible; such LEDs are known as PLEDs or FLEDs.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A solid state light fixture, comprising:

an adaptor plate that is adapted to be secured to a base to which the light fixture is to be mounted;

a heat sink adapted to be secured to said adaptor plate, said heat sink comprising a light engine mounting surface and a globe adaptor ring mounting surface on a first side thereof, and a plurality of heat dissipating elements on a second side thereof;

a light engine mounted to said light engine mounting surface;

a power supply mounted to said second side of said heat sink that is electrically connected to said light engine; and a globe adaptor ring adapted to be secured to said globe adaptor ring mounting surface, said globe adaptor ring adapted to receive an optically transmissive globe that encloses said light engine, and when said adaptor plate, heat sink, and globe adaptor ring are secured together, said heat dissipating elements provide a thermally conductive path between said heat sink and ambient air outside of the globe.

2. The solid state light fixture of claim 1, wherein said heat sink further comprises a wall extending from said first side thereof and enclosing said light engine mounting surface.

3. The solid state light fixture of claim 2, further comprising a cover lens secured to a top of said wall such that said light engine is enclosed within said cover lens, wall, and light engine mounting surface.

4. The solid state light fixture of claim 1, wherein said light engine mounting surface comprises one or more openings aligned with electrical connection elements of said light engine.

5. The solid state light fixture of claim 1, wherein said light engine comprises a plurality of light emitting diodes (LEDs).

6. The solid state light fixture of claim 5, wherein said light engine further comprises a plurality of secondary optics associated with said LEDs.

7. The solid state light fixture of claim 1, further comprising:

a reflector support secured to a globe adaptor ring mount; and a reflector secured to said reflector support configures to reflect light from said light engine to a target area.

8. The solid state light fixture of claim 1, wherein the base to which the light fixture is to be installed is an existing base adapted to support a non-solid state light fixture.

9. A system for securing a solid state light fixture to an existing light fixture pole having an existing mounting structure for an existing optically transmissive globe, comprising:

an adaptor plate that is adapted to be secured to the existing mounting structure;

a heat sink comprising a light engine mounting surface and a globe adaptor ring on a first side thereof, and a plurality of heat dissipating elements on a second side thereof, said heat sink adapted to be secured to said adaptor plate;

a light engine mounted to said light engine mounting surface; and a power supply mounted to said second side of said heat sink that is electrically connected to said light engine and adapted to be electrically connected to a utility power source;

said globe adaptor ring adapted to receive an optically transmissive globe that encloses substantially all of said first side, and when said adaptor plate and heat sink are secured together to the existing mounting structure, said heat dissipating elements provide a thermally conductive path between said heat sink and ambient air outside of the globe.

10. The system of claim 9, wherein said globe adaptor ring is adapted to receive the existing optically transmissive globe.

11. The system of claim 9, wherein said heat sink further comprises a wall extending from said first side thereof and enclosing said light engine mounting surface.

12. The system of claim 11, further comprising a cover lens secured to a top of said wall that encloses said light engine within said cover lens, wall, and light engine mounting surface.

13. The system of claim 9, wherein said light engine mounting surface comprises one or more openings aligned with electrical connection elements of said light engine.

14. The system of claim 9, wherein said light engine comprises a plurality of light emitting diodes (LEDs).

15. The system of claim 9, wherein said heat sink further comprises a globe adaptor ring mounting surface on said first side thereof, and wherein said globe adaptor ring is secured to said globe adaptor ring mounting surface.

16. The system of claim 15, wherein said globe adaptor ring has the same configuration as the existing mounting structure.

17. The system of claim 9, wherein said heat sink further comprises a power supply area on said second side thereof, said power supply located within said power supply area.

18. The system of claim 17, wherein said heat sink further comprises a wall extending from said second side thereof and enclosing said power supply area.

19. The system of claim 18, wherein said heat dissipating elements comprise a plurality of fins that extend from an outer circumference of the heat sink to an inner end that is separated from said wall.

20. The system of claim 9, wherein said heat dissipating elements comprise a plurality of pins that extend from said second side.

* * * * *